US010589166B2

(12) United States Patent
Estopinal

(10) Patent No.: US 10,589,166 B2
(45) Date of Patent: Mar. 17, 2020

(54) RETRACTABLE SURFACE SYSTEM AND METHOD OF INSTALLATION FOR THE RETRACTABLE SURFACE SYSTEM

(71) Applicant: Esto Retractable LLC, Jeffersonville, IN (US)

(72) Inventor: Robert Wayne Estopinal, Jeffersonville, IN (US)

(73) Assignee: ESTO RETRACTABLE LLC, Jeffersonville, IN (US)

( * ) Notice: Subject to any disclaimer, the term of this patent is extended or adjusted under 35 U.S.C. 154(b) by 0 days.

(21) Appl. No.: 16/103,133

(22) Filed: Aug. 14, 2018

(65) Prior Publication Data

US 2020/0054932 A1 Feb. 20, 2020

(51) Int. Cl.
*A63C 19/02* (2006.01)
*E01C 13/02* (2006.01)

(52) U.S. Cl.
CPC ..... *A63C 19/02* (2013.01); *E01C 13/02* (2013.01)

(58) Field of Classification Search
CPC ..... A63C 19/02; E01C 13/02
See application file for complete search history.

(56) References Cited

U.S. PATENT DOCUMENTS 2,884,252 A 4/1959 Thompson
3,508,747 A 4/1970 Orsatti
3,818,892 A * 6/1974 Von Kohorn ..... E01C 11/26 126/271.1
4,591,154 A 5/1986 Santarone
4,749,223 A 6/1988 Goeders
5,213,323 A 5/1993 Novinsky
5,467,977 A 11/1995 Beck
5,618,131 A 4/1997 Weber
5,624,112 A 4/1997 Hummel et al.
5,707,305 A 1/1998 Goeders et al.
5,716,295 A 2/1998 Anglea
5,769,745 A 6/1998 Bartoli
5,827,140 A * 10/1998 Bartoli ..... A63B 69/0002 473/497
5,919,103 A 7/1999 Bartoli
6,843,739 B2 1/2005 Putnam
D520,094 S 5/2006 Hess
(Continued)

FOREIGN PATENT DOCUMENTS

JP 06026298 Y 11/1988
JP H03222976 A 10/1991
(Continued)

*Primary Examiner* — Jeffrey S Vanderveen
(74) *Attorney, Agent, or Firm* — Scott R. Cox

(57) ABSTRACT

A retractable surface system, which is installed within an opening in a surface and a method of installing the retractable surface system within the opening in the surface. A mat is introduced into the opening. Secured within the mat are inner piers, which include a vertical sleeve to facilitate the lowering of a retractable surface within the opening, and outer piers, which include a vertical support column with upper and lower stops, which stabilize the retractable surface in a raised or lowered position within the opening. Supporting the retractable surface in the opening is a platform. A drive motor is secured to the platform and drives one or more systems for raising and lowering the platform within the opening.

20 Claims, 6 Drawing Sheets

(56) References Cited

U.S. PATENT DOCUMENTS

| | | | | |
|---|---|---|---|---|
| 7,090,586 | B1 * | 8/2006 | Everett | A63C 19/00 404/99 |
| 7,150,688 | B1 | 12/2006 | Coulbourn | |
| 7,344,459 | B2 | 3/2008 | Bykowsky | |
| 7,621,831 | B2 | 11/2009 | Roberts | |
| 7,927,238 | B2 | 4/2011 | Mejia Perez | |
| 8,157,678 | B2 | 4/2012 | Goeders | |
| 8,167,746 | B2 | 5/2012 | Massaro | |
| 8,216,095 | B2 | 7/2012 | Weber et al. | |
| 8,616,988 | B1 * | 12/2013 | Coffman | A63B 69/36 473/150 |
| 9,278,276 | B2 | 3/2016 | Estopinal | |
| 2004/0242352 | A1 | 12/2004 | Panus | |
| 2011/0192096 | A1 * | 8/2011 | Koberinski | E04B 5/43 52/126.6 |

FOREIGN PATENT DOCUMENTS

| | | | |
|---|---|---|---|
| JP | H0852251 | A | 2/1996 |
| JP | H08522552 | A | 2/1996 |
| JP | H0947540 | A | 2/1997 |
| JP | H0947541 | A | 2/1997 |
| JP | H10192473 | A | 7/1998 |
| JP | H10295872 | A | 11/1998 |
| JP | 2000140191 | A | 5/2000 |

* cited by examiner

RETRACTABLE SURFACE SYSTEM AND METHOD OF INSTALLATION FOR THE RETRACTABLE SURFACE SYSTEM

STATEMENT REGARDING FEDERALLY SPONSORED RESEARCH OR DEVELOPMENT

Not applicable.

BACKGROUND OF THE INVENTION

The present invention relates to a retractable surface system installed within an opening in a surface and a method of installing the retractable surface system into the opening within the surface, particularly a retractable athletic surface system and a method of installing the retractable athletic system into an opening of an athletic field.

The investment of public/private funds in facilities, particularly athletic facilities, requires significant funds. Unfortunately, because such facilities are often designed as single-use facilities, there is a lack of flexibility in use of many of these facilities for different activities. An example of such lack of flexibility are athletic facilities containing elevated surfaces used for pitching mounds, bull pen mounds, track and field fixtures or areas, such as pits/water obstacles, etc. Because of the structure of these features of athletic facilities, the flexibility to use these venues for other purposes is limited. Further, the expense of manual conversion of these facilities for multiple uses is substantial. In addition, the potential for injury of athletes using converted sports facilities is significant, without a better control of the surface of the playing fields of these facilities.

The seasons of athletic teams often overlap, placing a premium on making a field playable in a short period of time for multiple uses. Accordingly, it is critical for a field to be convertible and playable within 24 hours from use for one sport to use for a different sport. Further, game scheduling is often conducted by league administration and is not under the control of the respective athletic teams, making quick modification of the surface of the athletic field often necessary. Further, efficient transformation of a stadium from one event to another is critical with regard to materials and employees needed for a successful and quick transformation.

The ability to raise and lower various ground level features of athletic field surfaces or surfaces in general with minimal manpower and materials allows the surfaces to be converted from one use to another use efficiently and economically. This conversion ability also allows these venues to be more utilized and productive for multiple sports and the communities they serve. For example, such a conversion would allow a baseball playing field to be easily converted to use for football, soccer, band competitions, non-athletic events and music concerts.

For such conversions to be practical, there is a need for a system which will allow venues to use their primary playing surface without a tripping hazard that often occurs with raised or depressed athletic field features, such as pitching mounds. Further, when athletic surfaces, such as pitching mounds, cannot be removed, the presence of the pitching mound in the middle of the athletic field seriously limits the amount of seating for events such as concerts. Efficient conversions of athletic surfaces also contribute to safety of use of such surfaces for participants. Further, because the seasons for athletic teams overlap, a field is only available for a very short window of time to allow for initial installation of a retractable athletic surface.

Currently, a retractable athletic surface exists as discussed in U.S. Pat. No. 9,278,276. Unfortunately, because of its design and difficulty in installation, it is impractical to use and expensive to install. Further, the '276 patent requires the use of extensive excavation as installation and maintenance require use of a concrete foundation, which has to be precisely measured, poured and set within the opening in the athletic field. This concrete foundation has been impractical as it takes numerous skilled artisans to install, which takes significant time. Moreover, the skilled artisans must be trained in how to install and maintain the surface, which also takes time and results in excess costs and significantly limits the number of workers available. What is needed is an improved retractable surface system, which can be, for the most part, prefabricated and delivered to the surface, such as an athletic field, for quicker, more efficient installation and maintenance.

In addition, a quick and efficient method of constructing and installing a retractable surface system within an surface, such as an athletic field, in a short period of time is important to allow for optimal usage of the surface or athletic field. Further, this method of installing the retractable surface system should account for an on-site assessment of pre-existing conditions prior to construction of the retractable surface system. Further, a method of installing and constructing the retractable surface system is needed which allows for less excavation of the surface or athletic field and less on-site construction time to optimize surface and athletic field usage. This method of constructing a retractable surface system should also allow for precise quality control of the retractable surface.

The retractable surface system and method of installation disclosed herein eliminates the need for the complicated, multicomponent concrete foundation previously used, allows for precise quality control of the retractable surface via prefabrication of a majority of the components of the system, and significantly decreases the amount of time necessary for installation of the retractable surface system.

BRIEF SUMMARY OF THE INVENTION

In an embodiment of one invention disclosed herein, is a retractable surface system installed within an opening in a surface, wherein the system includes a mat located at a base of the opening, inner piers supported by the mat, wherein said inner piers contain a vertical sleeve, outer piers supported by the mat, wherein said outer piers support upper and lower stops, a raising and lowering system secured to the inner piers, and a platform to support a retractable surface, which platform is located within the opening and supported by the raising and lowering system.

In an embodiment of one invention disclosed herein, is a method of installing a retractable surface system within an opening of a surface, the method including excavating the opening within the surface, introducing a mat into a base of the opening, introducing outer piers and inner piers into the mat, securing a sleeve vertically within the inner piers to facilitate the lowering and raising of the system, securing upper and lower stops to the outer piers, securing a raising and lowering system into the inner piers, and securing a platform to the raising and lowering system.

Other objects and features of the invention disclosed herein will be apparent from the following.

DETAILED DESCRIPTION

Figure 1:
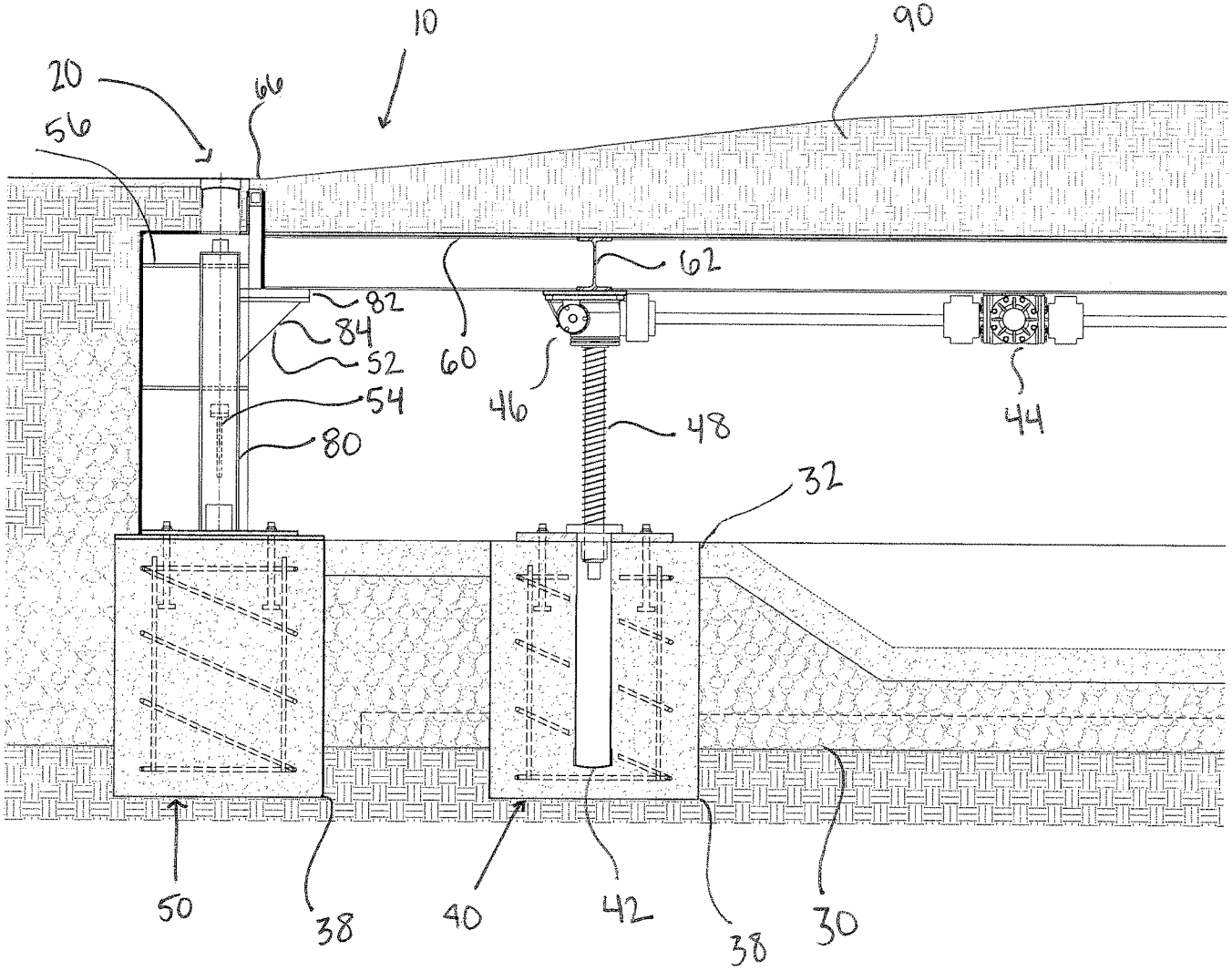
FIG. 1 is a cut away side view of a retractable surface system used with a pitching mound, which mound is in a raised position.
Figure 2:
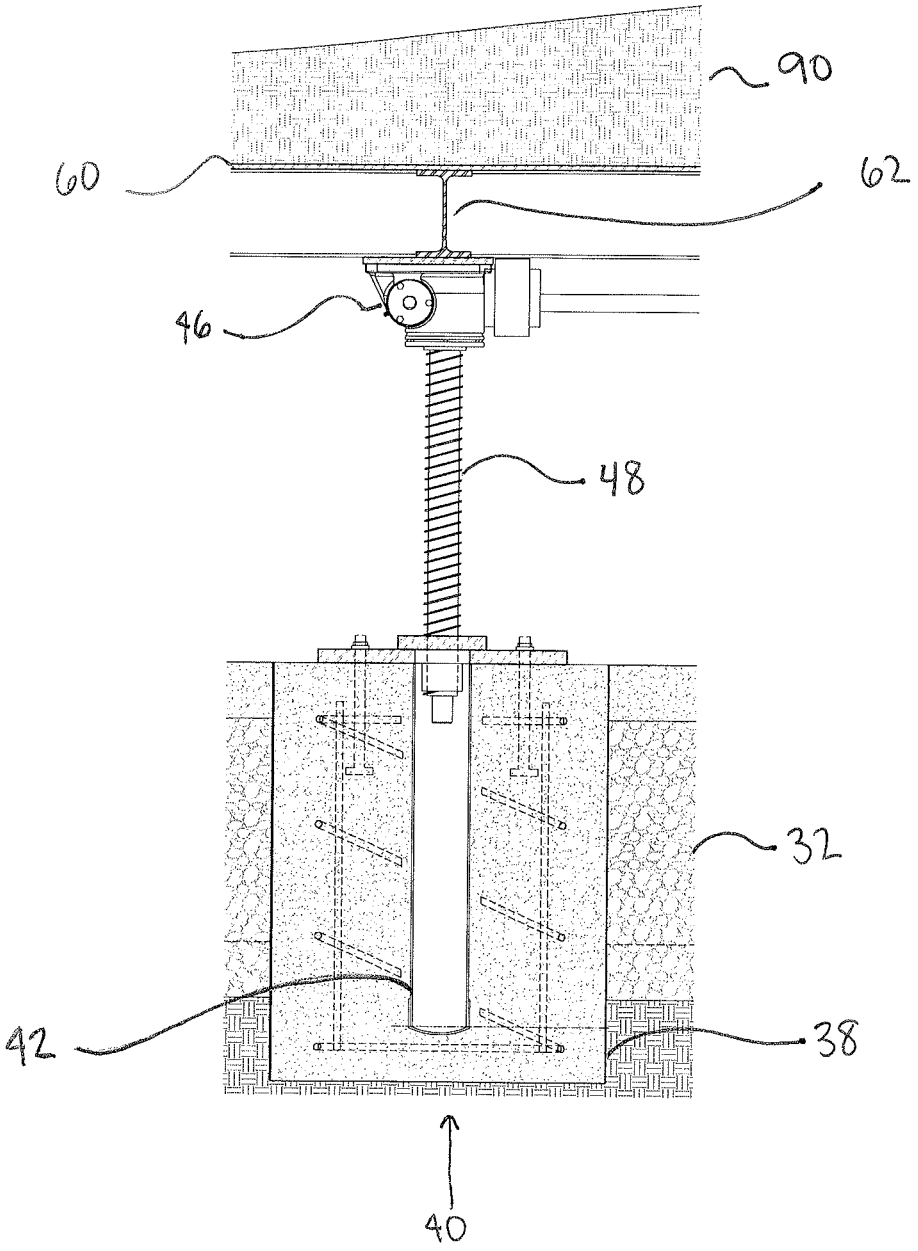
FIG. 2 is a cut away side view of an inner pier secured within a mat within an opening of a surface.
Figure 3:
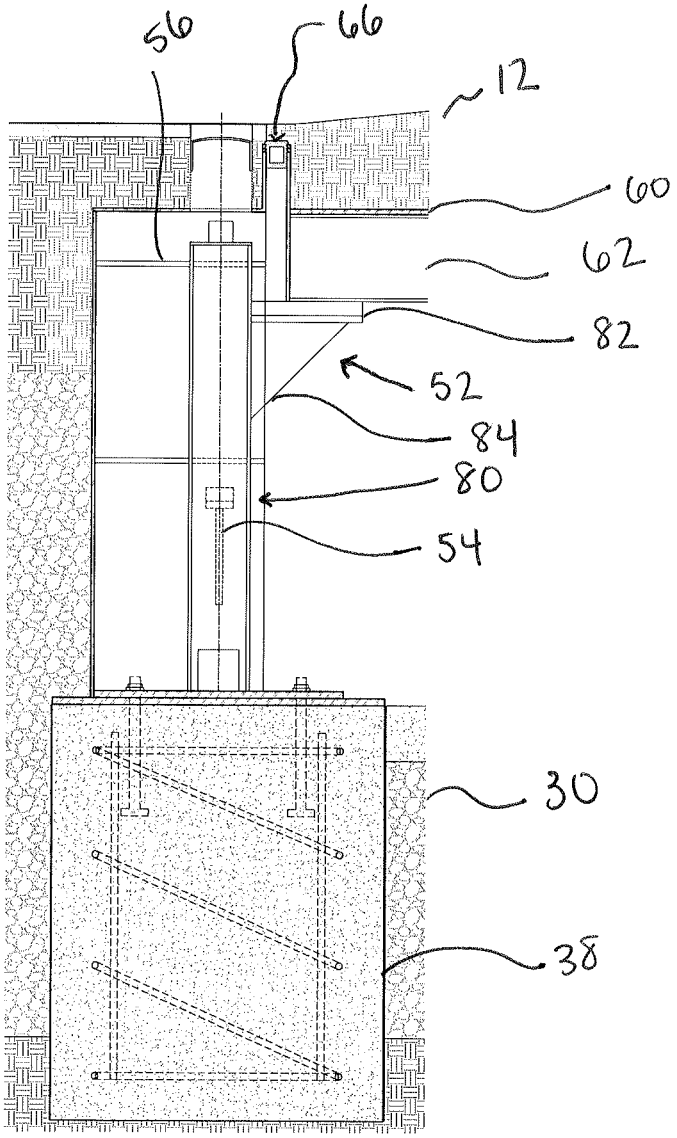
FIG. 3 is a cut away side view of an outer pier secured within a mat within an opening of surface.

One embodiment of an inventive concept disclosed herein is a retractable surface system (10), which is installed within an opening (20) of a surface, as shown in FIGS. 1-6. The surface can be any type of surface, but for purposes of the below detailed description, the surface is an athletic field. Further, an example of the retractable surface (12) that can be raised and lowered within the opening (20) is a pitching mound (90) for use within an athletic field, as shown in FIGS. 1-3. Alternatively and additionally, any type of athletic surface or athletic feature that requires modification in its height on or below the athletic field surface can utilize the disclosed system. For example, the disclosed system can also be useful for track and field features, such as water jumps, sand pits, landing zone mats or fixed hurdles.

In one embodiment, before excavation of the opening occurs, the athletic field is investigated for pre-existing conditions, which may negatively inhibit installation and maintenance of the retractable surface system (10). If any negative conditions are found, they are either removed, relocated, or the retractable surface system is modified to not conflict with the pre-existing structural elements. One way in which the retractable surface system can be modified is by adjusting the location of inner and outer piers (40, 50) in a way as to not conflict with the prior existing structural elements. The present system is significantly more flexible that the prior art systems as the prior art system required use of a monolithic concrete foundation. This concrete foundation could not be easily adjusted or modified around pre-existing structural elements. The new system is significantly more flexible as the inner and outer piers can be placed around the pre-existing structural elements so as to not interfere.

In one embodiment, a mat (30) is introduced into a base (32) of the opening, as shown in FIGS. 1-3. In one embodiment, the mat is a densely compacted gravel mat, which is compacted into the base of the opening. The mat supports both inner piers (40) and outer piers (50) which are introduced into the mat. In one embodiment, an opening for receiving each inner and outer pier is excavated in the mat. In one embodiment the outer piers are located near an outer surface of the opening generally forming a circular arrangement within the opening and the inner piers are located within a circumference formed by an outermost edge of the outer piers. In another embodiment, the outer piers are located near an outer surface of the opening generally forming a circular arrangement within the opening and the inner piers are located within a circumference formed by an innermost edge of the outer piers.

In one embodiment, a form (38) is placed in each respective inner and outer pier opening, as shown in FIGS. 1-3. Each form is filled with a setting material, such as concrete, which sets within each form. In one embodiment, reinforcement steel is also placed within the poured concrete of the form to further support the inner and outer piers, as shown in FIGS. 1-3. One example of a form that can be used is a Sonotube® form.

Figure 4:
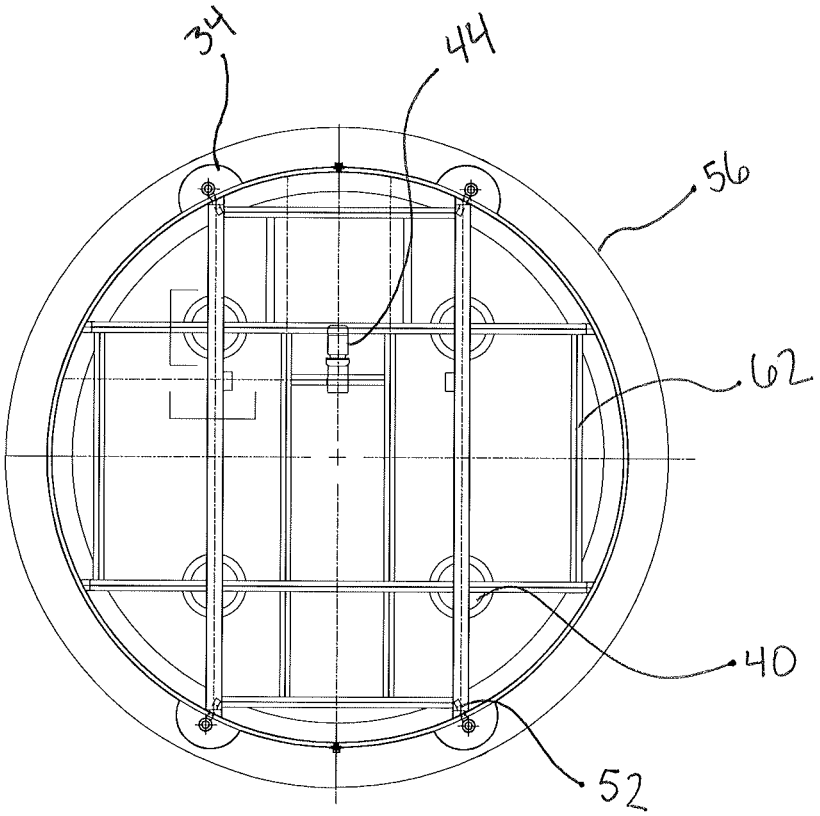
FIG. 4 is a top view of a support structure for supporting a platform of the system of FIG. 1.
Figure 6:
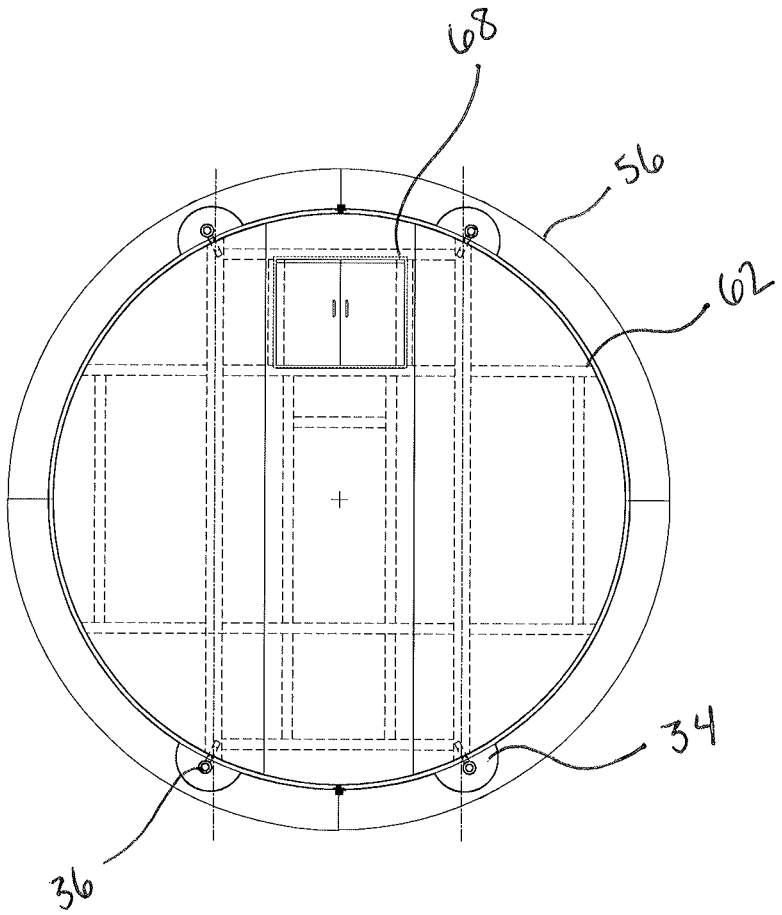
FIG. 6 is a top view of a support structure, with an access cover, for supporting a platform of the system of FIG. 1 with an access cover.

In one embodiment, secured to a top portion of the outer piers (50) are shaft stop assemblies (80), which include upper stops (52) and lower stops (54) (see FIGS. 1 and 3). In one embodiment, the shaft stop assemblies include a base plate secured to the lower portion of the shaft stop assemblies. This base plate is bolted into a form (38) of the outer piers as the forms are filled with concrete. The base plate secures the shaft stop assemblies in place, which comprise a vertical support column. The upper and lower stops are secured to the vertical support columns and hold and secure the retractable surface (12) in an upper and lower position within the opening (20). In one embodiment these shaft stop assemblies are placed within notches (34) of a retaining wall (56) which surrounds and further supports the outer piers, as shown in FIGS. 4 and 6. In the embodiment, shown in FIGS. 1 and 3, each of the upper stop and the lower stop consist of a steel plate (82) supported by a triangular steel support (84), which is secured to the shaft stop assemblies. The shaft stop assemblies are generally tubular in shape and rotatable around an internal pin (36) which extends into or is supported by the outer piers. The rotation of these shaft stop assemblies can be by mechanical or electrical means. In one embodiment, the upper and lower stops have the same shape and are both secured to the respective shaft stop assemblies. In one embodiment, they are located approximately 90 degrees apart axially on the shaft stop assemblies, as shown in FIGS. 1 and 3. By this location the shaft stop assemblies can be rotated from a position where the upper stops extend into the opening to support the platform (40), as shown in FIGS. 1 and 3, to a position where, after rotation of the upper stops and lower stops counterclockwise, the lower stops support the platform and the upper stops are rotated inwardly and do not support the platform. A top view of the upper and lower stops on the four shaft stop assemblies within notches is shown in FIGS. 4 and 6. The use of steel upper and lower stops allows for the platform (40) to be secured either in a raised or lowered position during events to reduce the possibility of the platform moving or swaying as heavy loads are applied to the platform.

In one embodiment, the outer piers (50) are further supported by and secured to a retaining wall (56) as shown in FIGS. 1, 3, 4 and 6. In one embodiment, the retaining wall comprises steel and is supported by the mat (30) and extends from the base (32) of the opening (20) to or near to a surface of the opening in the athletic field. In one embodiment, the retaining wall includes one or more notches or slots (34) which are useful during raising and lowering the retractable surface system as shown in FIG. 6. Included as an element of the base may be a number of useful additional components that are present because the opening extends below the surface of the athletic field. Such additional features may include, for example, a sump pump or other plumbing fixtures (not shown).

The inner piers (40) include a sleeve (42), which is vertically supported within the inner piers as shown in FIGS. 1 and 2. The sleeve aids in the raising and lowering of the retractable surface (12) via a raising and lowering system. In one embodiment, the sleeve is placed into form (38) after the form has been inserted into an inner pier opening excavated in the base (32) of the mat (30) as shown in FIGS. 1 and 2. Once the sleeve is properly situated, concrete is poured and set around the sleeve to support the sleeve and hold it into place. In one embodiment, reinforcement steel is additionally placed within the concrete for further support and reinforcement of the sleeve.

In one embodiment, the raising and lowering system includes well-known mechanical and/or electrical systems to raise and lower the retractable surface (12). One such system, as shown in FIG. 1, is a drive motor (44), which electrically drives mechanical screw jacks (46) along their drive shafts (48) to raise and lower the retractable surface. (See FIGS. 1, 2 and 4) The drive motor is connected to control wiring and a power supply at a remote location (not shown) so that the raising and lowering of the retractable surface system can be done remotely from said retractable surface system. Such wiring and power supply are located underground and are not shown in the drawings but are conventional.

The drive shafts (48), lowered by the mechanical screw jacks (46) extend downward into a sleeve (42), which is vertically secured within each inner pier (40) as shown in FIGS. 1-2. For example, see the location of the drive shafts within these sleeves in the inner piers from the position of the pitching mound (90) being in a raised position, as shown in FIGS. 1 and 2.

Figures 5, 5A:
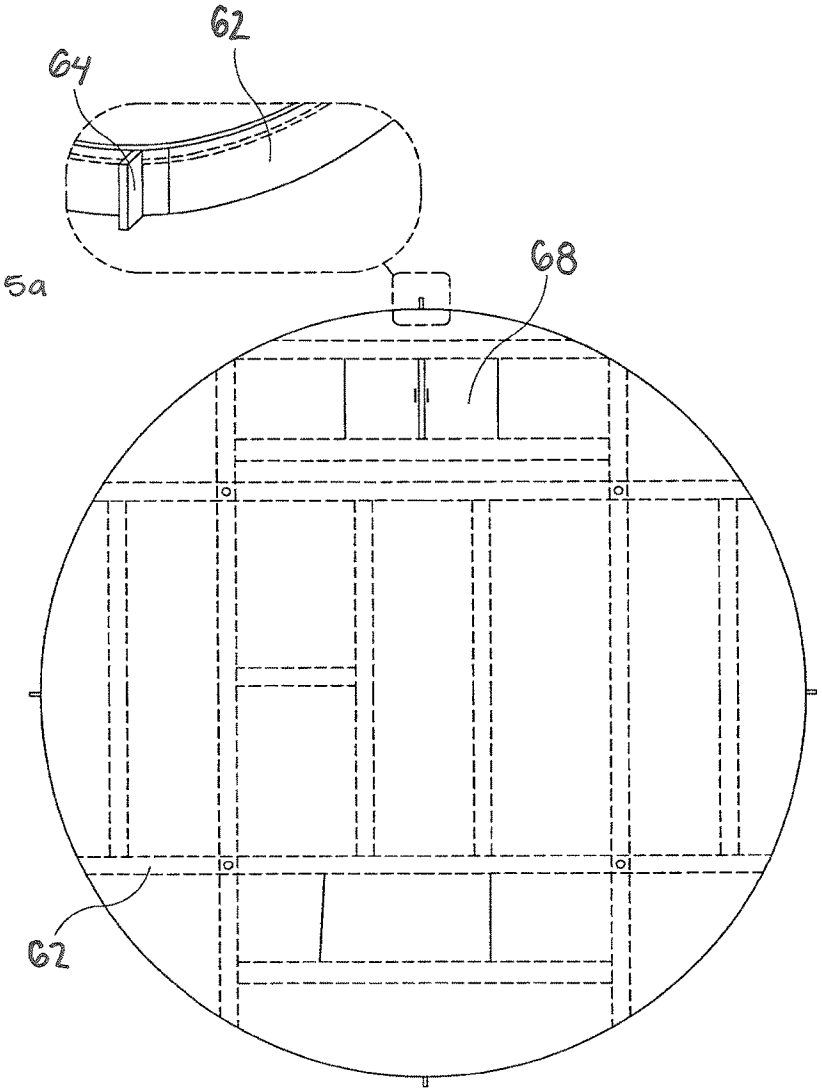
FIG. 5 is a top view of a support structure for supporting a platform of the system of FIG. 1.
FIG. 5A is a cut away perspective view of alignment guides secured to the support structure/platform of FIG. 5.

The use of one electrically powered drive motor (44), instead of multiple motors, allows for ease of replacement and maintenance of the motor. Access to the motor is provided by an access panel (68) in the platform (60), as shown in FIGS. 5 and 6. The screw jacks (46) are mounted on the underside or on an element of the steel platform to keep the jacks away from any water that may accumulate on mat (30) as shown in FIGS. 1-2.

In one embodiment, the platform (60) is supported by a support structure (62), a steel support structure, such as is disclosed in FIGS. 4, 5 and 6. The particular shape, size, depth and structure of this support structure within the opening can vary and have various shapes, sizes and depth depending upon the weight, height, size and location of the retractable surface. An additional feature of this platform with support structure is one or more alignment guides (64). These alignment guides may comprise steel extension elements that extend outward from an outside surface of the support structure as shown in FIG. 5A. These alignment guides may be secured to the platform and/or the support structure. The purpose of these alignment guides is to better align and maintain the alignment of the platform with the support structure within the opening (20) in the athletic field. In one embodiment, these alignment guides operate in conjunction with the retaining wall (56) to maintain the proper level of the retractable surface as it is raised and lowered within the opening in the athletic field.

In one embodiment, a rubber seal (66) is installed on top of the platform (60) to limit penetration of water and debris into the base as shown in FIGS. 1 and 3. Using this system, dead loads of significant weight can be used, even when filler soil is added when the platform is in a lowered position. Support of significant weight is critical to the performance of this system. Instead of the use of only filler soil, an insert, particularly a fiberglass or high-density foam insert, may be inserted to cover a pitching mound (90), when it is in a retracted position, to reduce the weight on the retractable surface. Further, in one embodiment, a fixed structural floor, preferably made of concrete, is set below the platform.

In use when the retractable surface (12), such as a pitching mound (90), is being used for baseball, the retractable surface is secured in a raised position, such as is shown in FIGS. 1 and 3. Note that the platform (60) and support structure for the platform (62) are supported by upper stops (52), which are secured to shaft stop assemblies (80), which are supported by the outer piers (50). When the retractable surface is lowered, the platform and support structure for the platform are supported by the lower stops (54), which are also secured to the shaft stop assemblies. Note also that in one embodiment, an insert, a fiberglass or high-density foam insert, is placed on the pitching mound when in this retracted position and atop this fiberglass or high-density foam is placed conventional fill materials, such as sand, dirt and artificial turf, as shown in FIGS. 1-2.

One method of installing the retractable surface system (10) includes excavating an opening (20) within an athletic field as shown in FIG. 1. A mat (30) is introduced into a base (32) of the opening. In one embodiment, the mat is dense gravel, which is compacted into the base of the opening. The prior art required a complicated concrete foundation formed in a complex form, which was expensive and timely to install and maintain. Further, there was little flexibility with the prior art system as the concrete had to be set into place using difficult forms. Any errors in construction were not easy to correct. The retractable surface system disclosed herein eliminates the need for the complicated, multicomponent concrete foundation previously used, allows for precise quality control of the retractable surface system via prefabrication of a majority of the components of the device, and significantly decreases the amount of time necessary for installation of the retractable surface system.

Once the mat (30) is successfully secured into the base (32) of the opening (20), inner piers (40) and outer piers (50) are introduced and secured within the mat as shown in FIGS. 1-3. In one embodiment, an opening for receiving each inner and outer pier is excavated in the mat. A form (38) is placed into each inner and outer pier opening. These forms are filled with concrete, which sets them into place within each inner and outer pier opening. Advantageously, the present system only requires the use of inner and outer pier forms, which are easy to move and install and requires no complex foundation. Further, these forms do not need to be removed once they are inserted into the mat. This increases efficiency and reduces costs over the prior art system, which required the use of many forms to aid in the proper placement of the concrete foundation. Even the slightest error in the pouring and placement of the concrete foundation could have adverse effects on the entirety of the system, which was costly, inefficient and difficult to fix. (see FIGS. 1-3).

In one embodiment, reinforcement steel is also placed within the poured concrete of the form (38) for further support of the inner and outer piers. The elevation of the top of the inner and outer piers is confirmed to ensure proper height for the retractable surface when in a raised and lowered position. In one embodiment, shaft stop assemblies (80) are secured to outer piers via a base plate which is bolted to the outer piers. In this embodiment, upper and lower stops (52, 54) are secured to the shaft stop assemblies to support the retractable surface in a raised and lowered position (see FIGS. 1 and 3).

In one embodiment, a retaining wall (56) is secured or bolted, to the outer piers, as shown in FIGS. 4, 5 and 6. In one embodiment, the retaining wall consists of multiple retaining wall sections, which are secured to one another to form one retaining wall located within the opening. Securing of the retaining walls to one another may be necessary to ensure the compressive nature of the retaining wall (see FIGS. 4 and 6).

In one embodiment, the inner piers (40) include a sleeve (42), which is vertically secured within the inner piers, as shown in FIGS. 1-2. The sleeve aids in the raising and lowering of the retractable surface and supports a raising and lowering system. In one embodiment, the sleeve is placed into a form (38) after the form has been inserted into the inner pier openings excavated in the base (32) of the opening (20). Once the sleeve is properly situated, concrete is poured and set around the sleeve to support the sleeve and hold it into place. In one embodiment, reinforcement steel is additionally placed within the concrete for further support and reinforcement of the sleeve. A raising and lowering system is secured to the inner piers to facilitate and support the raising and lowering of the retractable surface. In one embodiment, the raising and lowering system is installed by first installing screw jacks (46) at the inner piers (40) to ensure proper alignment of the screw jacks and drive shafts (48). The screw jacks are secured to the inner piers via a base plate which is secured to an upper portion of the inner piers via a threaded stud. This base plate is bolted into the form (38) of the outer pier while the concrete sets. The setting concrete further secures the sleeve in place to receive the drive shaft. All electrical power and wiring is connected to the screw jacks and complete backfill of the opening with soil and also dehumidifier in the area below the platform may be installed.

In one embodiment, the raising and lowering system is further secured to the platform (60) to raise and lower the retractable surface. In one embodiment, the platform is connected to the raising and lowering system by guide pins, which are welded to the raising and lowering system. Further, a support structure (62) may be secured between the platform and the raising and lowering system by bolting to the raising and lowering system and the platform via guide pins.

In one embodiment, the retractable surface (12) is placed on and/or secured to a platform (60), a steel platform, which is retractable within the opening (20) in the athletic field. Top layers of the retractable surface are secured on top of the platform to be raised and lowered into the opening of the athletic field as shown in FIGS. 1-2.

In one embodiment, following installation steps, calibration and testing of the retractable surface system (10) occurs. This process involves lowering the platform (60) without the top layers to the lower stop position and allowing the mound platform to rest on the lower stops (54). Calibration of any switches also occurs. The platform should be raised to the upper stop position to allow the platform to rest on the upper stops (52) and calibration of the limit switches should continue during this testing process. This process should be repeated at least five times to ensure that all vertical and horizontal tolerances are maintained. Following calibration and testing, installation of any top layers of the athletic retractable surface occurs.

While several embodiments of the present invention have been shown and described, it is understood that many changes and modifications can be made thereto without departing from the scope of the inventions as disclosed herein.

LISTING OF ELEMENTS

Retractable surface system—10
Retractable surface—12
Opening—20
Mat —30
Base—32
Notches—34
Internal pin—36
Form—38
Inner piers—40
Sleeve—42
Drive motor—44
Screw jacks—46
Drive shafts—48
Outer piers—50
Upper stops—52
Lower stops—54
Retaining walls—56
Platform—60
Support structure—62
Alignment guides—64
Seal—66
Access panel—68
Shaft stop assemblies—80
Steel plate—82
Triangular steel support—84
Pitching mound—90

The invention claimed is:

1. A retractable surface system installed within an opening in a surface comprising:

A mat located at a base of the opening;

Inner piers supported by the mat, wherein said inner piers comprise a vertical sleeve;

Outer piers supported by the mat, wherein said outer piers comprise upper and lower stops;

A raising and lowering system secured to the inner piers; and

A platform to support a retractable surface, which platform is located within the opening and supported by the raising and lowering system.

2. The retractable surface system of claim 1, wherein the mat comprises a compacted aggregate.

3. The retractable surface system of claim 1, wherein the inner and outer piers further comprise concrete.

4. The retractable surface system of claim 1, wherein the outer piers are located near an outer surface of the opening forming a circular arrangement within the opening and the inner piers are located within a circumference formed by an outermost edge of the outer piers.

5. The retractable surface system of claim 1, wherein the outer piers are located near an outer surface of the opening forming a circular arrangement within the opening and the inner piers are located within a circumference formed by an innermost edge of the outer piers.

6. The retractable surface system of claim 1, wherein the outer piers are further secured to a retaining wall within the opening.

7. The retractable surface system of claim 6, wherein the upper and lower stops are secured to shaft stop assemblies, which shaft stop assemblies are secured to a top portion of the outer piers and have a tubular shape.

8. The retractable surface system of claim 7, wherein the shaft stop assemblies are further secured within a slot in the retaining wall, wherein the upper stops or the lower stops extend inwardly within the opening upon rotation of the shaft stop assemblies.

9. The retractable surface system of claim 1 further comprising a support structure secured to the platform.

10. The athletic surface system of claim 9, wherein the support structure further comprises alignment guides, which assist in alignment of the platform within the opening.

11. The retractable surface of claim 1, wherein the retractable surface comprises a pitching mound.

12. The retractable surface system of claim 1, wherein the raising and lowering system comprises one or more screw jacks designed to raise and lower the platform within the vertical sleeve of the inner piers.

13. The retractable surface system of claim 1, wherein the platform further comprises an access panel providing access through the platform to a drive motor.

14. The retractable surface system of claim 13 further comprising control wiring and a power supply electrically connected to the drive motor and located outside of the opening in the surface.

15. The retractable surface system of claim 1 further comprising a foam or fiberglass insert which covers the retractable surface.

16. The retractable surface system of claim 7, wherein the upper stops are secured to the shaft stop assemblies at a location at least 90 degrees rotationally from a position of the lower stops, which are also secured to the shaft stop assemblies.

17. A method of installing a retractable surface system within an opening in a surface comprising the steps of:

Excavating an opening within a surface;

Introducing a mat into a base of the opening;

Introducing inner and outer piers into the mat;

Securing upper and lower stops to the outer piers;

Securing a sleeve vertically within the inner piers;

Securing a raising and lowering system into the sleeve of the inner piers; and

Securing a platform to the raising and lowering system.

18. The method of claim 17, wherein prior to excavating the opening, examining the surface for pre-existing structural elements for removal or relocation, or modification of the placement of the inner and outer piers.

19. The method of claim 17, further comprising securing the inner and outer piers within the mat by placing a form filled with concrete within the mat.

20. The method of claim 19, further comprising inserting reinforcing steel into the form prior to filling the form with concrete.

* * * * *